United States Patent [19]

Cooley

[11] Patent Number: 4,815,691

[45] Date of Patent: Mar. 28, 1989

[54] METHOD AND APPARATUS FOR MAKING ICE CUBES

[76] Inventor: Richard Cooley, 21000 Gist Rd., Los Gatos, Calif. 95030

[21] Appl. No.: 185,865

[22] Filed: Apr. 25, 1988

[51] Int. Cl.[4] ..... B28B 7/26

[52] U.S. Cl. ..... 249/120; 241/121; 241/126; 241/129; 241/141

[58] Field of Search ..... 62/66, 340; 249/120, 249/121, 126, 127, 129, 141

[56] References Cited

U.S. PATENT DOCUMENTS

| | | | |
|---|---|---|---|
| Re. 31,890 | 5/1985 | Vangedal-Nielsen | 249/61 |
| 2,961,850 | 11/1960 | Tupper | 249/127 X |
| 3,306,567 | 2/1967 | Frei, Sr. | 249/127 X |
| 3,443,785 | 5/1969 | Ewers | 249/126 X |
| 4,241,492 | 12/1980 | Hedberg | 29/527 |
| 4,366,941 | 1/1983 | Harris | 249/120 |
| 4,372,526 | 2/1983 | Daenen et al. | 249/126 X |
| 4,432,529 | 2/1984 | McMillan | 249/126 X |
| 4,627,595 | 12/1986 | Rhodes et al. | 249/128 X |

*Primary Examiner*—William E. Tapolcai

*Attorney, Agent, or Firm*—Limbach, Limbach & Sutton

[57] ABSTRACT

A method and apparatus for making ice cubes is disclosed wherein a large number of ice trays or liquid trapping elements are placed in a larger container, liquid added to the larger container to a level which will fill the liquid trapping elements when the container is positioned in an ultimate storage position and in the ultimate storage position, all the liquid not trapped in the trapping elements is drained. Apparatus disclosed is a container for closely receiving a plurality of ice trays and a lid with a closeable drain opening. A closeable opening is shown in a container wall. Racks can be provided on one container wall and the container can be made of insulating material.

13 Claims, 2 Drawing Sheets

10
12
12a
12b
12c
12d
12e
12f
18
20
23
22a
22b
22c
22d
14
17
16
24
22
12
4
15
13

METHOD AND APPARATUS FOR MAKING ICE CUBES

TECHNICAL FIELD

The present invention is directed generally to method and apparatus for making ice cubes.

BACKGROUND OF THE INVENTION

The conventional method and ice trays for making ice cubes in a refrigerator freezer involves a number of problems principally related to the time and care needed to fill and place ice trays filled with water in the refrigerator freezer section and the water spillage that occurs during this process. Simultaneous filling of several trays at a time is not possible. The loading and transport of a single tray usually involves spillage. Transport of the open trays is a problem. The open trays sometimes absorb odors from the other foods in the freezer. Shrinkage of ice by evaporation is a problem in frost free freezers. Standard ice trays are awkward to transport and provide no insulation to preserve the ice.

Various attempts have been made to provide an ice tray that is more convenient to fill and less susceptible to spillage than the standard tray with a plurality of cavities or a subdividing section that is nearly filled with water and then carried to the freezer compartment. U.S. Pat. Nos. 2,691,850, 4,433,785, 4,241,492, 4,372,526, 4,432,529, and 4,627,595 show various tray designs, many of which include covers to prevent spillage and permit stacking for carrying to the freezer compartment. Most of these patents suffer from potential spillage as well as extensive time required for filling the trays and placing them in the freezer compartment.

In an effort to solve some of the problems with ice trays, manufacturers have created refrigerators with ice makers. These entail a considerable added expense for the consumer and are only accommodated by newer houses with specialized plumbing. Older houses require considerable plumbing expenses to accommodate an ice marker refrigerator.

It is therefore, the object of the present invention to provide an easily portable container capable of allowing the simultaneous filling of a plurality of ice trays or forms wherein the excess water is drained off, thus preventing spillage during transport and storage.

A further object of the invention is to provide a container wherein ice trays are independently contained and thus not subject to being trapped in ice formed in the freezing compartment.

A further object of the invention is to provide a container which prevents odor absorption or evaporation of the ice formed within.

A further object of the invention relates to the form wherein the walls of the containers are insulated allowing for freezing when the lid is off the storage and transport and ice preservation for parties and picnics by merely putting on the insulated lid.

The container in which the ice was formed now also becomes an insulated ice bucket.

SUMMARY OF THE INVENTION

Broadly stated, the present invention is directed to a method and apparatus wherein a large number of ice trays or liquid trapping elements are placed in a larger container, liquid added to the larger container to a level which will fill the liquid trapping elements when the container is positioned in an ultimate storage position, placement of the container in that liquid storage position and draining from the container all of the liquid but that liquid trapped in the trapping elements.

The container with the excess liquid drained can be sealed and carried to the freezer compartment or the container can be used to dispense the excess liquid in other locations such as in potted plants which need watering before the container is placed in the freezer compartment.

In accordance with the preferred embodiment of the present invention, the container takes the form of a rectangular pitcher with an open top into which a plurality of closely fitting ice trays, typically four, can be inserted either before or after the pitcher is filled with water. A cover with a spout is then provided on the pitcher and the pitcher placed in a position so that the excess water not trapped in the tray compartments can be drained out of the spout in the cover while the pitcher is tilted and then jiggled to reduce the water level in the trays from a brimming full level before the spout is closed. The spout is located in the substantially lowest level of the pitcher when the pitcher is tilted to the position for draining the excess water. The closed pitcher with the full trays can be carried to the freezer without any spillage.

Two containers in accordance with the present invention, each containing four ice trays, can conveniently be filled together. The excess water drained from the first container can be used to fill the second container.

In accordance with another embodiment of the present invention the walls of the container are made of insulating material whereby the container can double as an insulated ice bucket.

DESCRIPTION OF THE PREFERRED EMBODIMENT

Figures 1, 2, 3, 4, 5:
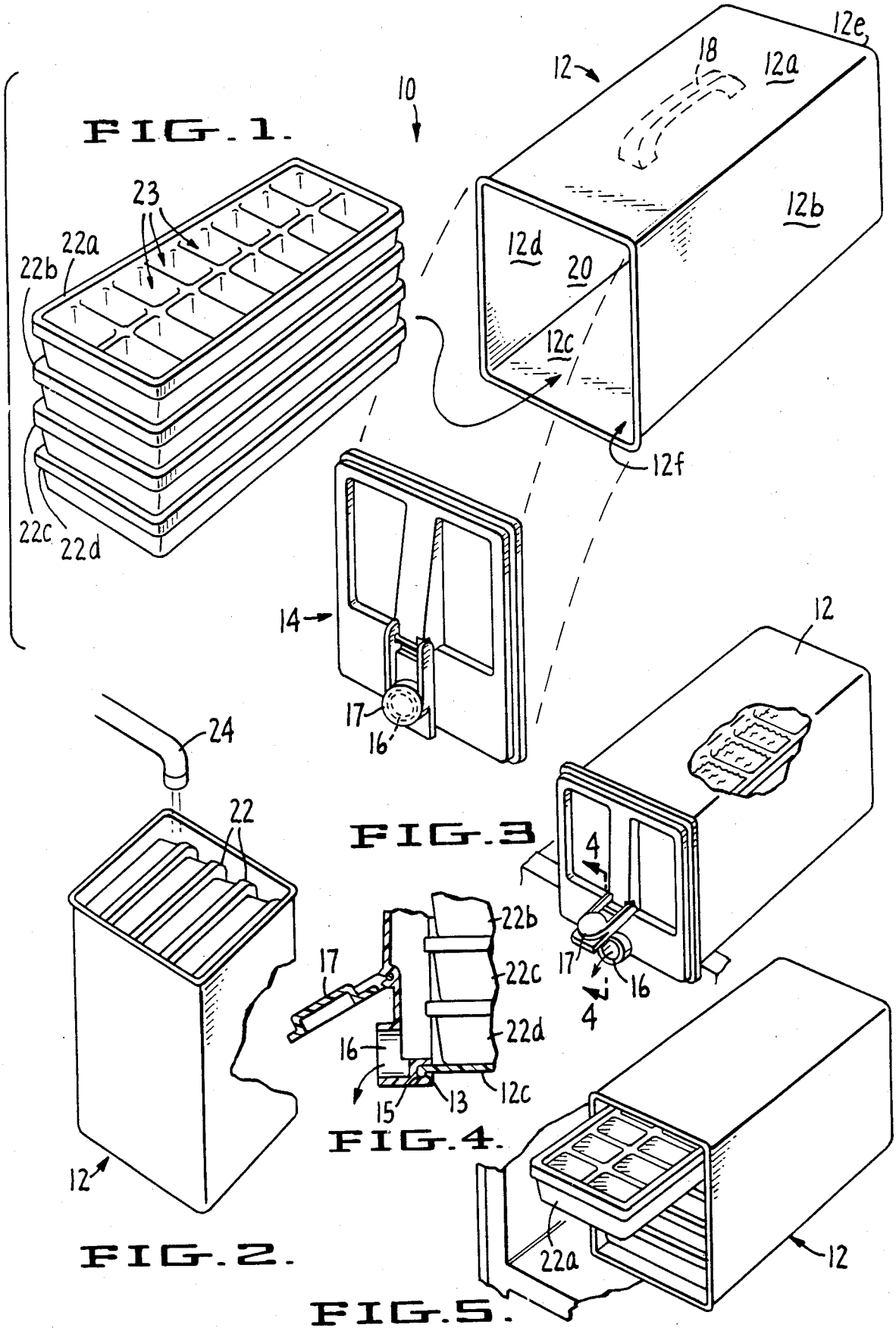
FIG. 1 is a perspective view of an assembly in accordance with the present invention with the parts shown in exploded position.
FIG. 2 is a perspective vertical view of the assembly as shown in FIG. 1, while being filled.
FIG. 3 is a perspective view, partially broken away, of the assembly shown in FIG. 1, filled as in FIG. 2 and positioned for draining of the excess water.
FIG. 4 is a partial elevational sectional view of a portion of the assembly shown in FIG. 3 taken along line 3—3 in the direction of the arrows.
FIG. 5 is a perspective view of the assembly shown in FIG. 1 in a freezer compartment with the container lid removed and one of the ice trays being withdrawn.

Referring now to the drawings with particular reference to FIGS. 1 through 5, there is shown a portable storage assembly 10 for the transport, storage and freezing of liquid in accordance with the present invention. The storage assembly 10 includes a rectangular portable container 12 in the form of a hollow rectangular parallel piped of some durable material, such as, for example, polyurethane. The container 12 has four sides 12*a*–12*d*, a bottom 12*e* and an open top 12*f*. The open top 12*f* may be closed by means of a snap-on press-fit lid 14. As shown in FIG. 4 the lid 14 has a snap fit channel 15 which fits over and receives the upper lip 13 around the opening 12*f* in the top of container 12 and has a spout-type drainage hole 16 which is provided with a hinged cup 17. A carrying handle 18 is provided on one container side wall 12*a*. A chamber 20 is defined in the container 12 when the lid 14 is in place.

A plurality of trays, preferably four in number and generally designated 22*a*–22*d*, are stacked on their sides so as to fit closely in the chamber 20 within the container 12. Each tray has compartments 23 which may be of uniform or varying dimensions.

As shown in FIG. 2 the trays 22 are inserted in the container 12, and with the container 12 positioned upright on its bottom wall 12*e* such as in a kitchen sink, water is added from a faucet 24 to fill the container 12. In upright position, the vertical height of the container is less than the height of the faucet 24 above the bottom of a sink. The lid 14 is placed over the container open top 12*f*, and the assembly 10 is tipped on its side or storage position as shown in FIG. 3 to drain the excess water. The container can be jiggled or slightly tipped to reduce the water level in the tray compartment 23 from brim full and the spout cap 17 closed. Then the assembly 10 is carried to and placed within the freezer. No spillage will occur on the floor or in the freezer compartment.

Obviously, the filling procedure described above can be altered. For example, the lid 14 can be placed on top of the container 12 and the container filled through the spout opening 16. Alternatively, open container 12 can be filled with water and then the trays 22 inserted in the water.

It has been found that two storage assemblies 10 can be quickly and conveniently filled in a minimum amount of time with no spillage. For example, two containers each having ice cubes in four trays can be removed from the freezer section. The trays from one container are removed and water turned on to start filling the contaner while ice is removed from the four ice trays which are then inserted into the water filling or already filled in the container. The trays from the other container are removed and water added to the other container from the faucet while the lid is placed on the first container and the first container tipped to drain the excess water into the second container. The first container also could be set on the edge of the sink and the water allowed to drain while ice is removed from the four trays of the second container and those four trays inserted into the second container which is being filled with water. The lid is then provided on the second container which is tilted to drain the excess water. The caps can then be closed on the two container spouts and the containers taken together to the freezer compartment.

As mentioned above, for convenience and conservation of water a container filled with its ice trays and water can be carried around to other locations needing water, such as potted plants, and the cap opened to drain water as desired before the container, with all the water except that desired in the trays fully drained, is placed in the freezer compartment.

The completely enclosed container in the freezer compartment prevents absorption of odors in the ice being formed as well as prevents evaporation of the ice over a period of time which will occur in frost-free freezers. Numerous modifications can be made in the preferred embodiment still within the scope of the present invention. For example, a small ventilation hole could be provided on the opposite side of the lid 14 from the opening 16 to allow for faster flow of excess water out of the container.

Additionally, the walls of the container 12 and/or lid 14 can be made of an insulating material, such as plain Styrofoam or Styrofoam which may also be covered with a dense or surface skin.

The container 12 and/or lid 14 and/or trays 22 can include provision such that the trays will only fit in the container and allow the lid 14 to be placed on the container such that the opening or drain 16 will be at the bottom of the container when the container is in storage position with the trays 22 positioned to hold water.

Figure 7:
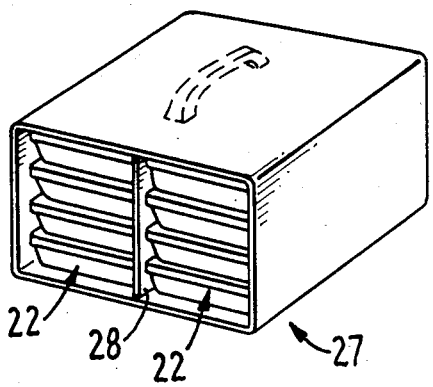
FIG. 7 is a perspective view of a container for eight ice trays with the lid removed.

With reference to FIG. 7 instead of two containers each holding four ice trays a container 27 can be provided for holding eight ice trays 22. Container 27 has a central divider 29 which can be omitted. Containers for other specified numbers of trays can be constructed in accordance with this instruction.

Figure 6:
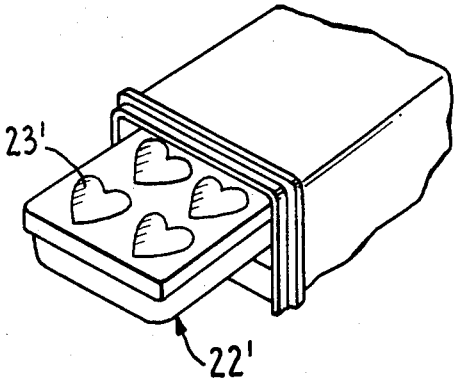
FIG. 6 is a partial perspective view of another embodiment of the present invention.

FIG. 6 depicts another embodiment of the trays 22'. The compartments 23' of the trays 22, may be of varying styles and dimensions.

Figure 8:
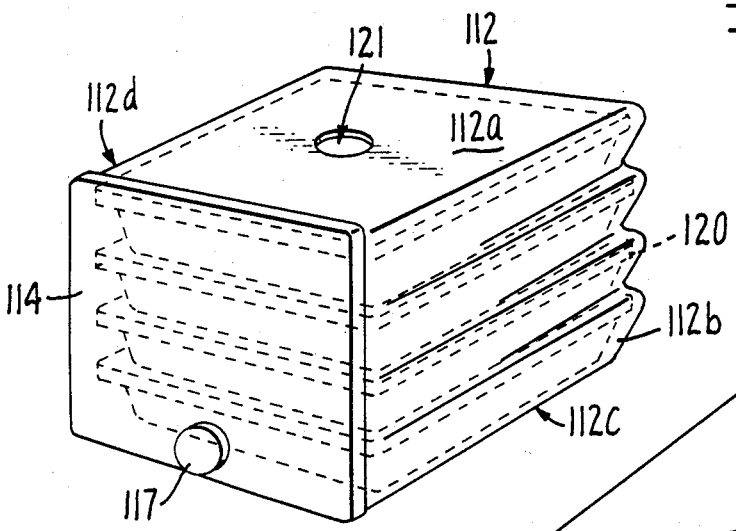
FIG. 8 is a schematic view of another embodiment of the present invention.

FIG. 8 represents yet another embodiment of the present invention. A square hollow container 112 is depicted with top 112*a*, sides 112*b* and 112*d*, bottom 112*c*, and a rear end (not visible) and a front closure or lid 114 with a drain opening 116 having a cap 117. One side panel 112*b* is ribbed, so as to form interior racks 120 for trays 122 within the container 112. The racks 120 insure that the trays 122 will fit in the container 112 in only one way. The top panel 112*a* of the container 112 has a liquid reception hole 121 for adding water. The trays 122 are inserted on the racks 120 in the container 112 and, the lid 114 with its cap in place is then snapped over the open end of the container 112. Liquid is then introduced into the container 112 through the liquid reception hole l21 to fill the container 112. During filling the drain hole 116 can be closed by a finger of the person filling the container with water. Liquid fills the trays 122 and excess liquid drains via the drainage hole 116 after cap 117 or the filler's finger is removed. The drainage hole 116 may then be capped to retard evaporation of the liquid and to resist spillage of the liquid during transport to the freezer. A cap or stopper can close the fill hole 121. With the construction in FIG. 8, the container does not have to be shifted between filling and draining position because these positions are the same.

Figure 9:
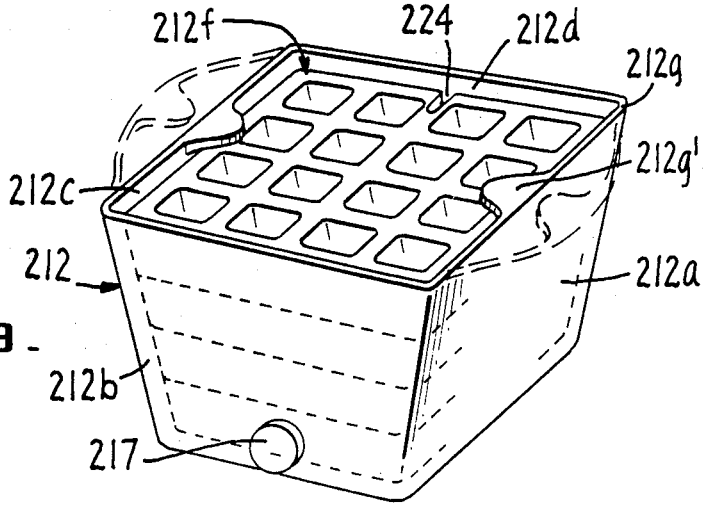
FIG. 9 is a schematic perspective view of still another embodiment of the present invention.

FIG. 9 represents yet another embodiment of the present invention. The container 212 has four trapezoidal sides 212*a*–212*d* and a bottom 212*e*. The top 212*f* of the container is open. The trays 222*a*–222*d* of progressively smaller peripheral dimensions are vertically stacked within the container 212. Each tray 222 has a vertical slot 224 located on one side of the tray 222 to allow water to flow down into the container 212. The upper end of container 212 has an expandable rim 212*g* with interior tabs 212*g'*. The rim 212*g*, when expanded, easily allows the vertical stacking of the trays 222.

When in normal state, the rim 212g and the interior tabs 212g' retain the trays 222 within the container 212 A drainage hole 216 with cap 217 is located at the bottom of one of the trapezoidal sides so as to allow the escape of excess liquid. Liquid is poured into the uppermost tray 222. When filled, excess liquid exits the uppermost tray 212 through the slot 224 and escapes to the next lowest tray 222. This process is repeated until all the tray 222 are filled. Then the cap 216 is removed and the excess water drained.

Figure 10:
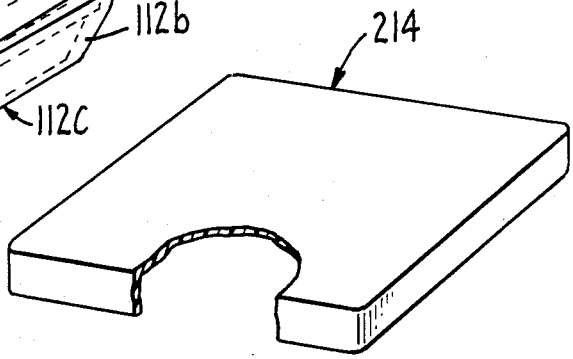
FIG. 10 is a perspective view, partially in section of a container lid for an alternative embodiment of the present invention.

A lid 214, such as shown in FIG. 10, made of insulating material can be placed on the container 212 in the freezer once the ice cubes have frozen. With the container 212 also made of insulating material, the container 212 and lid 214 can be used as an ice bucket.

The terms and expressions which have been employed herein are used as terms of description and not of limitation, and there is no intention, in the use of such terms and expressions, of excluding equivalence of the feature shown and described, or portions thereof, it being recognized that various modifications are possible within the scope of the invention claimed.

I claim:

1. An assembly for the transportation, storage and freezing of liquid without spillage comprising:

a plurality of individual trays, each having at least one partially open cavity capable of retaining and storing liquid; and a hollow container having a chamber closely receiving said plurality of trays;

said chamber in a storage position holding said trays for retaining liquid and having a closeable opening at substantially the lowest point of said chamber whereby liquid can be added to said container and the excess liquid beyond the liquid retained in said trays drained from said chamber through said opening.

2. The apparatus in accordance with claim 1 having a second opening for inserting said trays into said container.

3. The apparatus of claim 2 wherein said closable opening is below the partial opening into the cavity of said trays when said assembly is in storage and freezing position.

4. The assembly of claim 3 wherein the partial opening into said cavities of said trays are other than horizontal in the position of said container in which fluid can be added whereby said container is shifted from the position in which liquid is added to the storage and freezing position.

5. The assembly of claim 4 wherein said container is a rectangular four-paneled pitcher with the open mouth forming said second opening and a lid closing said second opening including a closeable drainage hole forming said closeable opening.

6. A device according to claim 1 wherein said trays are divided into compartments, each compartment capable of retaining and storing liquid.

7. A device according to claim 6 wherein said compartments are of either varying or uniform dimension.

8. A device according to claim 1 wherein said container has handle means for easily grasping and transporting said container.

9. A device according to claim 1 wherein the height of the container in the position in which liquid is added to the container is less than the height of a kitchen sink faucet above the sink bottom.

10. A device according to claim 1 including means permitting said trays to fit within said container in only one position relative to said closeable opening.

11. The assembly of claim 3 wherein the partial openings into said cavities are substantially horizontal in the position of the container for adding liquid whereby the position of said container in which liquid is added is substantially the same position as said storage and freezing position.

12. The assembly of claim 1- wherein said container is formed of a thermally insulating material.

13. An ice cube freezing assembly comprising:

a hollow pitcher with an open upper end, a plurality of ice trays closely fitting on end within said pitcher, each tray having at least one partially open cavity capable of retaining and storing liquid, and a lid securably closing said pitcher open upper end, said lid having a spout along the edge of the lid opposite the edge of said container at which said tray open cavities are located and a closure for said spout, whereby said container can be filled with liquid and positioned in a freezing and storage position in which water is retained in said tray cavities and excess water is drained through said spout.

* * * * *